US006216933B1

(12) United States Patent
Healy

(10) Patent No.: US 6,216,933 B1
(45) Date of Patent: Apr. 17, 2001

(54) TENNIS BALL HOLDING ACCESSORY

(76) Inventor: Vandra Healy, 5 Clifford Dr., Ballston Lake, NY (US) 12019-9740

( * ) Notice: Subject to any disclaimer, the term of this patent is extended or adjusted under 35 U.S.C. 154(b) by 0 days.

(21) Appl. No.: 09/447,739

(22) Filed: Nov. 23, 1999

Related U.S. Application Data

(60) Provisional application No. 60/109,373, filed on Nov. 23, 1998.

(51) Int. Cl.[7] ..... A45C 1/04

(52) U.S. Cl. ..... 224/663; 224/677; 224/681; 224/919

(58) Field of Search ..... 224/660, 663, 224/676, 677, 681, 235, 240, 904, 919

(56) References Cited

U.S. PATENT DOCUMENTS

| | | | | |
|---|---|---|---|---|
| D. 245,947 | * | 10/1977 | Finley | D3/221 |
| 3,361,312 | * | 1/1968 | Hutchison | 224/240 |
| 4,079,871 | | 3/1978 | Sica . | |
| 4,416,404 | * | 11/1983 | Daniels | 224/676 |
| 5,259,541 | | 11/1993 | Reese . | |
| 5,289,960 | | 3/1994 | Kelly et al. . | |
| 5,326,005 | * | 7/1994 | Fisher | 224/661 |
| 5,395,022 | | 3/1995 | Vandewall . | |
| 5,683,019 | | 11/1997 | Schaber . | |
| 5,704,531 | * | 1/1998 | Nam | 224/676 |
| 5,788,170 | | 8/1998 | Hester . | |
| 5,836,497 | * | 11/1998 | Pelish | 224/677 |
| 5,950,896 | * | 9/1999 | Theodore | 224/647 |

* cited by examiner

*Primary Examiner*—Stephen K. Cronin
(74) *Attorney, Agent, or Firm*—Nixon & Vanderhye P.C.

(57) ABSTRACT

An accessory that is readily around a tennis player's waist holds enough tennis balls to effectively play a game, but not too many so as to crowd the player's stroke. A bag made of nylon has an interior volume which holds the tennis balls, accessible through an opening with a piece of elastic biasing the bag closed at the opening. A nylon cord attached to a key ring is sewn to the bag so that the key ring extends into the interior volume adjacent the opening. The front and back panels making up the bag are preferably folded at their side edges, and first stitching is provided at a first fold and second stitching at a spaced location from the first fold, for maximum strength and durability. A nylon pouch large enough to hold a cell phone or eyeglasses may be attached to the back panel of the bag so that the pouch is hidden when the bag is worn on a belt around a human's waist with the front panel of the bag facing outwardly.

20 Claims, 3 Drawing Sheets

Fig. 1
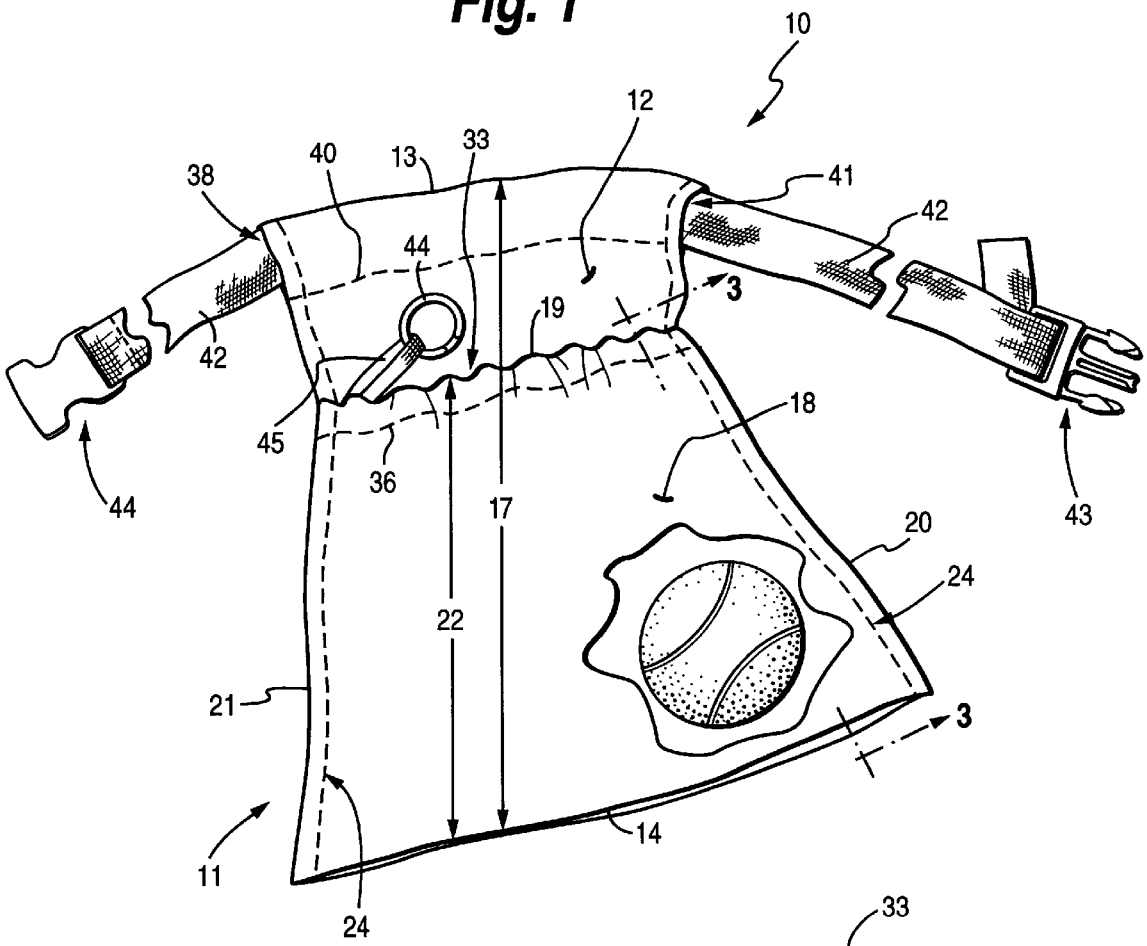
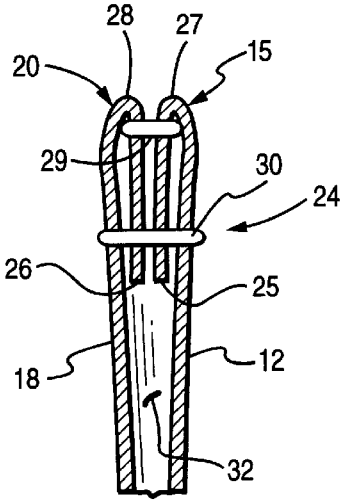
Fig. 2
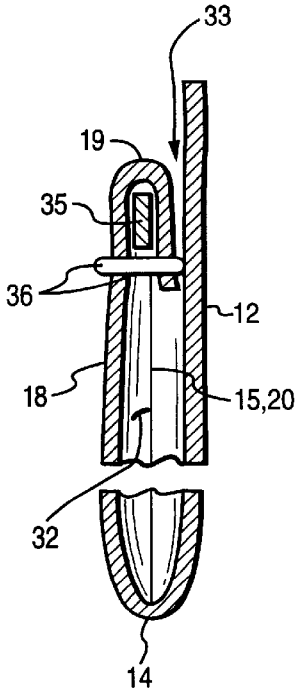
Fig. 3

TENNIS BALL HOLDING ACCESSORY

CROSS REFERENCE TO RELATED APPLICATION

This application is based upon provisional application Ser. No. 60/109,373 filed Nov. 23, 1998, the disclosure of which is hereby incorporated by reference herein.

BACKGROUND AND SUMMARY OF THE INVENTION

The average tennis player wants to be able to spend most of his/her time on the court in actually playing, rather than collecting balls, trying to find his or her keys or cell phone, or worrying about them being stolen, etc. According to the present invention an accessory for tennis players is provided which holds tennis balls in association with the user while the user is playing tennis in an optimum manner, and provides additional functionality. The accessory according to the invention comfortably holds enough balls (typically at least four, preferably exactly six regulation tennis balls) to play a typical game without having to stop to search for or collect balls, so that the game keeps moving; but not so many balls as to crowd the user's stroke. The accessory according to the invention can be worn on the front, side, or wherever it feels most comfortable.

The accessory according to the present invention is constructed of rugged material, and in an effective manner, so that it will have the maximum life, washability, and resistance to tearing or wear, while being as light as possible. Also, a key ring can be mounted in the interior volume of the accessory so that one can readily keep his/her keys (such as a key to a locker, house, or car) on the court, and doesn't have to worry about them being lost or stolen. Similarly, a hidden pouch may be provided on the back of the accessory which fits a cell phone, eyeglasses, pager, credit cards, ID or the like. This enhances the versatility and functionality of the accessory even more.

According to one aspect of the present invention an accessory for holding tennis balls in association with a tennis player (user) while the user is playing tennis is provided. The accessory comprises the following components: a bag formed of nylon and comprising: A back panel with a top and a bottom and first and second sides, and a first length from the top to the bottom thereof; a front panel having a top and a bottom and first and second sides and a second length from the top to the bottom thereof, the second length less than the first length so that the top and bottom of the front and rear panels are spaced from each other; and attachment means for holding the front panel to the back panel along or adjacent the first and second side edges of the front panel. The front and back panels are integral at the bottoms thereof. An interior volume of the bag defined between the front and rear panels, and an opening being provided at the top of the front panel large enough for passage of a regulation tennis ball therethrough, and the interior volume being large enough to hold at least four regulation tennis balls therein with ready access through the opening. Elastic at the opening associated with the front panel for biasing the front panel to partially close the opening. And a belt attachment at the top of the back panel.

For example, the volume may be large enough to hold exactly six regulation tennis balls. Preferably, there also is provided a nylon cord (which may be elastic) attached to at least one of the front and back panels, and to a key ring, so that the key ring extends into the interior volume adjacent the opening. Keys on the key ring do not interfere with access to the balls or play, but can be retained in association with the player. The nylon cord typically may be sewn to both the front and back panels adjacent the side edges thereof.

Typically, the attachment means comprises stitching, and in order to provide maximum strength and durability, the front and back panels are folded to define a first fold at said side edges thereof, and wherein said stitching comprises first stitching not visible from the exterior of said bag at said first fold, and second stitching spaced from said first fold and visible from the exterior of said bag.

Typically, the belt attachment comprises an elongated belt loop formed in the back panel; and further comprises a belt extending through the elongated belt loop and having a plastic male fastener at or adjacent a first end thereof, and a cooperating plastic female fastener at or adjacent a second end thereof. Also, preferably the accessory further comprises a nylon pouch large enough to hold a cell phone or eyeglasses attached to the back panel opposite the front panel so that the pouch is hidden when the bag is worn on a belt around a human's waist with the front panel facing outwardly from the human.

The accessory is preferably dimensioned so that the bag interior volume is, at the bottoms of said front and back panels, about 9 inches wide, and has a height of about 7 inches, and the bag is preferably made from a single piece of nylon fabric having dimensions of about 10 by 20 inches, and the attachment means comprises stitching.

According to another aspect of the present invention there is provided an accessory for holding tennis balls comprising: a bag formed of nylon and comprising: A back panel with a top and a bottom and first and second sides, and a first length from the top to the bottom thereof; a front panel having a top and a bottom and first and second sides and a second length from the top to the bottom thereof, the second length less than the first length so that the top and bottom of the front and rear panels are spaced from each other; and attachment means for holding the front panel to the back panel along or adjacent the first and second side edges of the front panel. The front and back panels are integral at the bottoms thereof. An interior volume of the bag defined between the front and rear panels, and an opening being provided at the top of the front panel large enough for passage of a regulation tennis ball therethrough, and the interior volume being large enough to hold at least one regulation tennis ball therein with ready access through the opening. Elastic at the opening associated with the front panel for biasing the front panel to partially close the opening. A nylon cord attached to at least one of the front and back panels, and to a key ring, so that the key ring extends into the interior volume adjacent the opening. And a belt attachment at the top of the back panel. The details of the accessory are preferably as described above.

According to yet another aspect of the present invention there is provided an accessory for holding tennis balls comprising: A bag formed of nylon and comprising: a back panel with a top and a bottom and first and second sides, and a first length from the top to the bottom thereof; a front panel having a top and a bottom and first and second sides and a second length from the top to the bottom thereof, the second length less than the first length so that the top and bottom of the front and rear panels are spaced from each other; and attachment means for holding the front panel to the back panel along or adjacent the first and second side edges of the front panel. The front and back panels are integral at the bottoms thereof. An interior volume of the bag defined between the front and rear panels, and an opening being provided at the top of the front panel large enough for passage of a regulation tennis ball therethrough, and the interior volume being large enough to hold at least one regulation tennis ball therein with ready access through the opening. Elastic at the opening associated with the front panel for biasing the front panel to partially close the opening wherein the front and back panels are folded to define a first fold at the side edges thereof, and wherein the stitching comprises first stitching not visible from the exterior of the bag at the first fold, and second stitching spaced from the first fold and visible from the exterior of the bag. And a belt attachment at the top of the back panel. The details of the accessory may be as described above.

The present invention provides a more durable and/or functional construction than in the prior art, allowing a tennis match to proceed more smoothly, without interruption, while still not interfering with the player's stroke, and providing additional functionality of holding important other items directly on the player's body without significant interference with his or her ability to play a match. In this regard the invention has advantages compared to conventional constructions for similar purposes, such as shown in U.S. Pat. Nos. 5,259,541, 5,289,960, and 4,079,871 (the disclosures of which are hereby incorporated by reference herein).

It is a primary object of the present invention to provide an advantageous accessory for holding tennis balls while a user is playing tennis. This and other objects of the invention will become clear from an inspection of the detailed description of the invention and from the appended claims.

BRIEF DESCRIPTION OF THE DRAWINGS

FIG. 1 is a front schematic view of an exemplary tennis player's accessory according to the present invention;

FIG. 2 is a detailed schematic cross sectional view showing the preferred attachments along the sides of the front and back panels;

FIG. 3 is a detailed schematic cross sectional view showing the elastic band fit in the opening at the top of the interior volume of the bag according to FIG. 1;

DETAILED DESCRIPTION OF THE DRAWINGS

Figure 4:
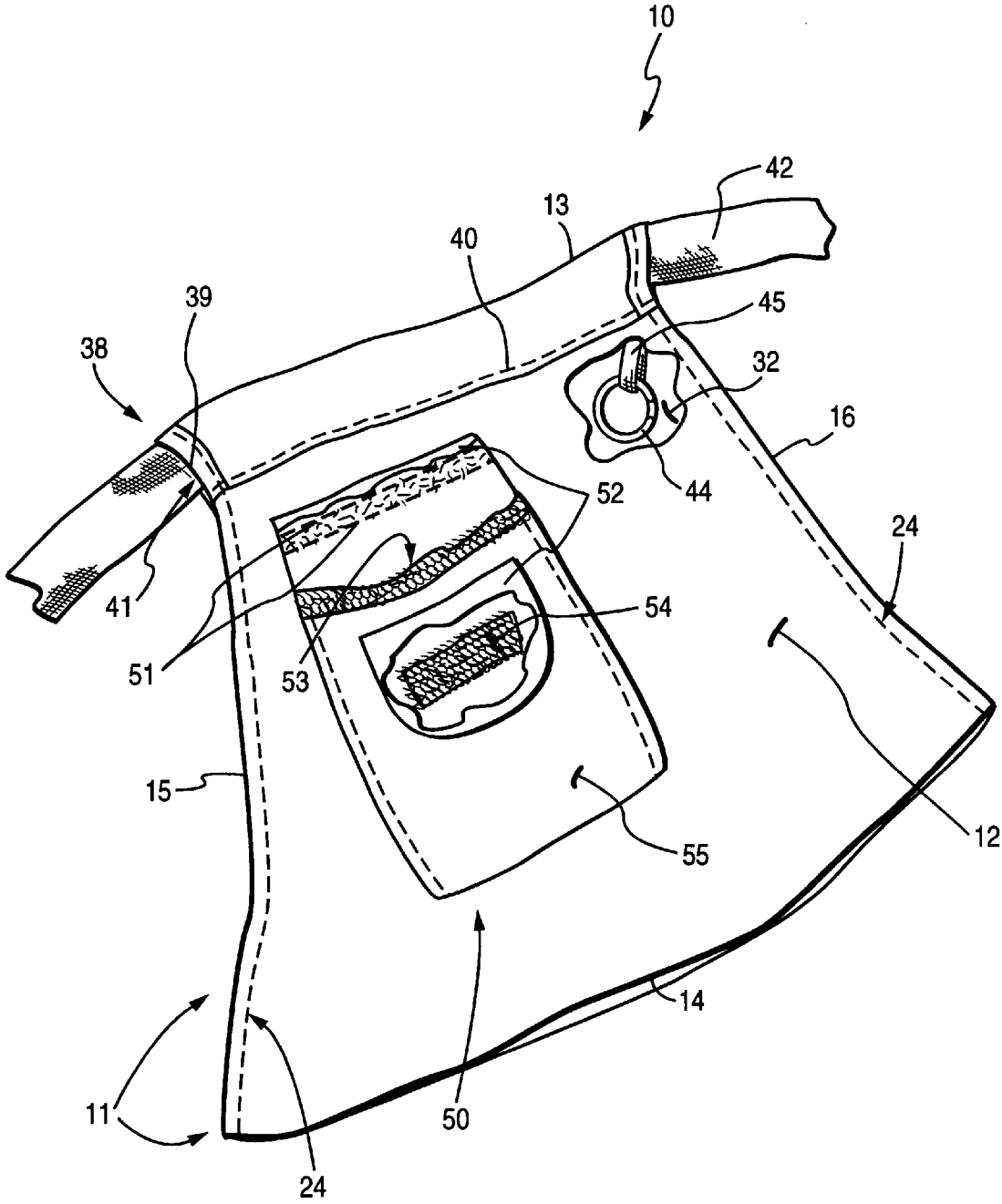
FIG. 4 is a rear perspective view of the bag FIG. 1 and showing an additional pouch associated therewith.

An accessory for holding tennis balls in association with the user while the user is playing tennis is illustrated schematically at reference numeral 10 in FIGS. 1 and 4. The accessory comprises a bag 11 formed of nylon (such as from a 10"×20" piece of 100% DuPont nylon) and has a back panel 12 with a top 13 and a bottom 14, and first and second sides 15, 16 (see FIGS. 2 and 4) and a first length 17 from the top 13 to the bottom 14 thereof; and a front panel 18 having a top 19 and a bottom 14 (in the preferred embodiment the bottoms of the panels 12, 18 are integral, as seen in all of FIGS. 1, 3 and 4), first and second sides 20, 21 (see FIGS. 1 and 2), and a second length 22 between the top 19 and bottom 14 thereof less than the length 17. Attachment means are provided for holding the panels 18, 12 together along the edges 20, 21 of the front panel 18 thereof. The attachment means may comprise ultrasonic welds, adhesive, mechanical fasteners, or—in the preferred embodiment illustrated in the drawings—stitching indicated schematically at 24 in FIGS. 1 and 4, or any other suitable conventional mechanism for holding two panels of nylon together.

FIG. 2 illustrates particular stitching that may be provide as the attachment means so as to provide the best aesthetics and strength. As seen in FIG. 2, both the free ends 25, 26 of the edges 15, 20 of the panels 12, 19, respectively, are folded over to provide a first fold 27, 28, respectively. A line of stitching—shown schematically at 29 in FIG. 2—is provided adjacent the first fold lines 27, 28, but not visible from the exterior of the panels 12, 19 to hold the panels 12, 19 together at the fold 27, 28. Then second stitching—shown schematically at 30 in FIG. 2—is provided between the stitching 29 and the free ends 25, 26, and extends through the four layers of nylon fabric formed at the edges 15, 20—as seen in FIG. 2, and is visible from the exterior. The stitchings 29, 30 preferably are of a strong thread, such as nylon.

An interior volume—see 32 in FIG. 3—the bag 11 is defined between the front and rear panels 18, 12 with an opening 33 (see FIGS. 1 and 3) being provided between the panels 12, 18 at the top 19 of the front panel 18. The opening 33 is large enough for passage of a regulation tennis ball therethrough. Preferably the interior volume 32 is large enough to hold at least one regulation tennis ball therein, preferably at least four regulation tennis balls, and most preferably exactly six regulation tennis balls. When holding six regulation tennis balls for the average player enough balls are provided so that the player need not undesirably interrupt his/her match to collect balls, but yet does not provide such a bulge or mass as to interfere with the player's stroke or movement.

Further, the accessory 10 also comprises elastic—seen at 35 in FIG. 3, and the deforming effective of the elastic being readily apparent in FIG. 1—at the opening 33 associated with the front panel 18 for biasing the front panel 18 to partially close the opening 33, so that balls within the interior volume 32 do not have a tendency to move out of the volume 32, yet the player can easily insert his/her hand, or another ball through the opening 33 (deforming the elastic 35) into the interior volume 32. In the preferred embodiment illustrated in the drawings, the elastic 35 is provided within a folded over loop at the top 19 of the front panel 18, with stitching 36—or other attachment means—holding the loop closed and maintaining the elastic 35 therein. The ends of the elastic 35 are also preferably stitched in place by the stitching 24.

Also, a belt attachment is provided at the top of the back panel. The belt attachment in the preferred embodiment is seen schematically at 38 in FIGS. 1 and 4. In this embodiment the belt attachment comprises a looped over portion of the back panel 12, seen at 39 in FIG. 4, which is stitched or otherwise attached in place to another portion of the panel 12 as illustrated schematically by the stitching 40 in FIGS. 1 and 4. The elongated loop 41 so formed is large enough to receive a conventional belt of the type used in fanny packs, and/or such as shown in U.S. Pat. Nos. 5,289,960 and 5,259,541. The loop 41 is elongated, preferably extending the entire width of the top 13 of the back panel 12. Also, the belt attachment, in this embodiment, preferably comprises the belt 42 extending through the elongated loop 41, and having a conventional plastic male fastener 43 (see FIG. 1) at or adjacent a first end thereof, and a cooperating plastic female fastener 44 at or adjacent a second end thereof. The fasteners may be as illustrated in the U.S. Pat. No. 5,289,960 patent.

Although the belt attachment described above is preferred, especially since the accessory 10 can be removed from the belt 42 and washed or cleaned, or put with another belt, if desired instead of the elongated loop 41 two or more individual spaced loops can be provided, or a belt like the belt 42 can be stitched or otherwise permanently attached to the panel 12 adjacent the top 13 thereof, or different belt segments may be attached to either end of the panel 12 adjacent the top 13 thereof, etc.

While dimensions may vary depending upon particular functions desired, typically the bag 11 is made from a piece of nylon 10"×20", and the interior volume 32 (when the elastic 35 is stretched out) has a width (that is along the bottom 14) of about 9 inches, and a height (the height 22) of about 7 inches.

Another highly desirable feature of the accessory 10 according to the invention is the provision of the key ring 44 (see FIG. 1). The key ring 44 is conventional, and has looped therethrough a cord or band 45 which is attached to the bag 11. Preferably the cord or band 45 comprises a nylon (which may be elastic) cord which is stitched or otherwise attached to one or both of the panels 18, 12. In the preferred embodiment illustrated in FIG. 1, both the stitching 36 and 24 stitches the ends of the cord 45 (which may be about 3 inches long) to both the panels 12, 18. While the ring 44 is shown above the opening 33 in FIG. 1 for clarity of illustration, typically during use it extends into the interior volume 32, as seen in FIG. 4. The key ring 44 allows the user to place his/her keys on the ring 41 (such as for a locker, car, or house) so that they stay with the player—but do not interfere with his or her movements—while playing tennis.

Another desirable feature according to the present invention that optionally may be provided is illustrated in FIG. 4 comprises a nylon pouch shown schematically at 50, large enough to hold a cell phone, eyeglasses, credit cards, pager and/or ID. The pouch 50 is attached to the back panel 12 by any suitable attachment mechanism or means, opposite the front panel 18, so that the pouch 50 is hidden when the bag 11 is worn on a belt 42 around a human user's waist with the front panel 18 facing outwardly from the human user (as seen in FIG. 1).

Figure 5:
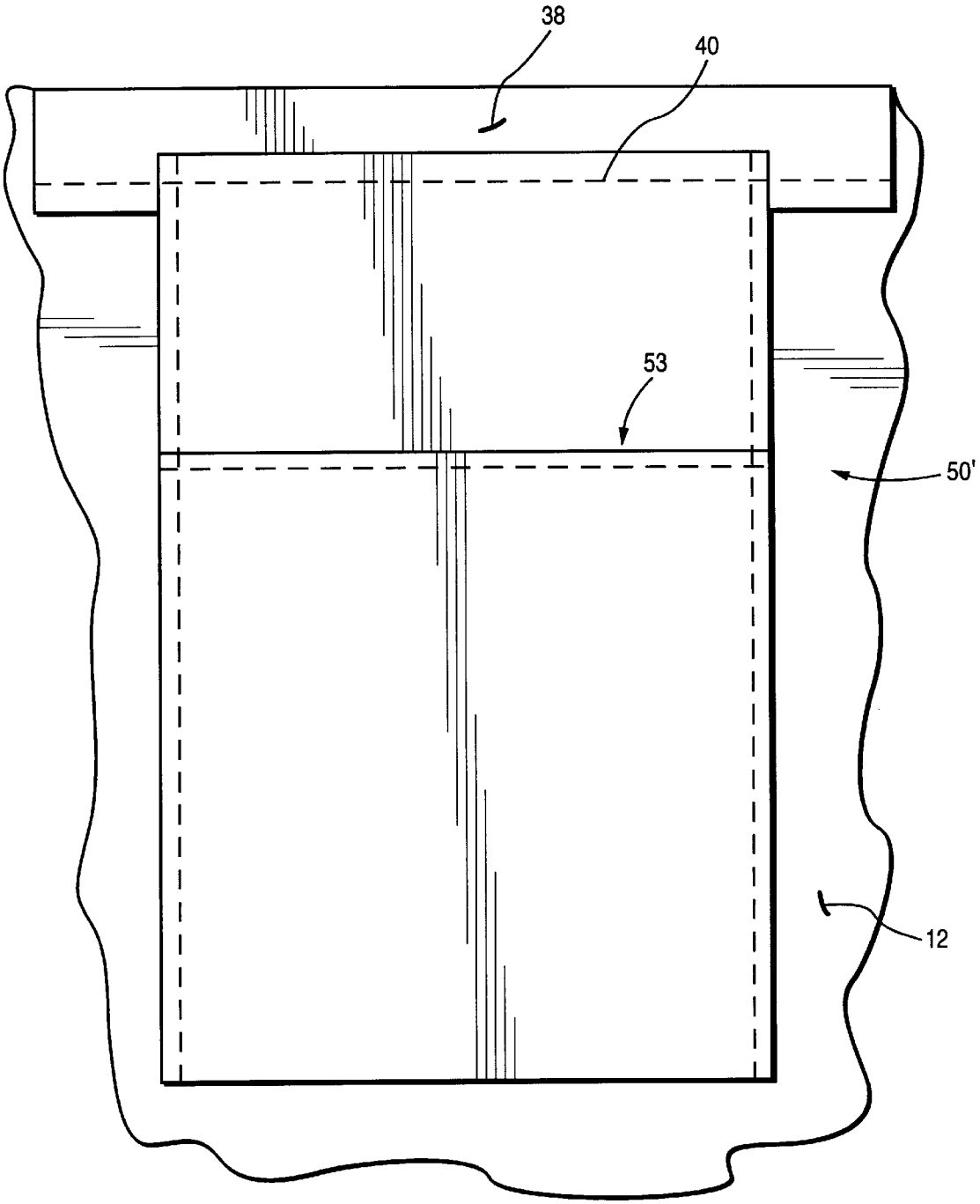
FIG. 5 is a rear view of another embodiment of the bag with pouch of FIG. 4.

The pouch 50 may have a wide variety of constructions as long as it performs the function indicated above. In the exemplary (only) embodiment illustrated in FIG. 4, the pouch 50 is attached only by the double stitching rows 51 adjacent the top thereof to the back panel 12, above the top 19 of the front panel 18, so that it has freedom of movement; or the stitching 40 may be the only stitching attaching the pouch 50 to the panel 12. Alternatively, it could be stitched along its entire length, or otherwise attached, to the back panel 12, including the belt attachment portion 38 thereof (by stitching 40). See the FIG. 5 embodiment for pouch 50'. The pouch 50 schematically illustrated in FIG. 4 has a flap 52 (cut away in a number of instances in FIG. 4 to reveal underlying structures) which covers an opening 53 into the interior of the pouch 50. The flap 52 may be secured in place by any conventional suitable mechanism, such as cooperating conventional hook and loop fasteners (e.g. Velcro) illustrated schematically at 54 in FIG. 4, one of the hook or loop fasteners attached to the inside of the flap, and the other attached to the outside surface 55 of the pouch 50. Completed, the pouch 50, 50' preferably measures about 8½"×about 4u with the pocket size as 4"×6". The seam allowance within the garment sides is ¼" with a ½" allowance for the top attachment leaving a 2" smooth drop before the approximate 2½" pocket opening 53. (The standard cell phone measures approximately 5¾"–6" length, 2" to 2¼" width, and approximately 1½" to 2¼" in depth—the same approximate measurements for a standard eyeglass case.) The pouch 50, 50' opening 53 may face toward the rear panel 12 of the accessory 10, because to use it easily the user must lift up the accessory 10 and there find the front opening 53 (e.g. not covered by a flap).

It will thus be seen that according to the present invention a highly function, aesthetic, and advantageous accessory for tennis players has been provided. While the invention has been herein shown and described in what is conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. An accessory for holding tennis balls in association with a user while the user is playing tennis, comprising:

a bag formed of nylon and comprising: a back panel with a top and a bottom and first and second sides, and a first length from the top to the bottom thereof; a front panel having a top and a bottom and first and second sides and a second length from the top to the bottom thereof, said second length less than the first length so that said top and bottom of said front and rear panels are spaced from each other; and attachment means for holding said front panel to said back panel along or adjacent said first and second side edges of said front panel;

said front and back panels being integral at said bottoms thereof;

an interior volume of said bag defined between said front and rear panels, and an opening being provided at said top of said front panel large enough for passage of a regulation tennis ball therethrough, and said interior volume being large enough to hold at least four regulation tennis balls therein with ready access through said opening;

elastic at said opening associated with said front panel for biasing said front panel to partially close said opening; and a belt attachment at said top of said back panel.

2. An accessory as recited in claim 1 wherein said volume is large enough to hold exactly six regulation tennis balls.

3. An accessory as recited in claim 1 further comprising a nylon pouch large enough to hold a cell phone or eyeglasses attached to said back panel opposite said front panel so that said pouch is hidden when said bag is worn on a belt around a human's waist with said front panel facing outwardly from the human.

4. An accessory as recited in claim 1 wherein said bag interior volume is, at said bottoms of said front and back panels, about 9 inches wide, and has a height of about 7 inches.

5. An accessory as recited in claim 4 wherein said bag is made from a single piece of nylon fabric having dimensions of about 10 by 20 inches, and said attachment means comprising stitching.

6. An accessory as recited in claim 5 wherein said front and back panels are folded to define a first fold at said side edges thereof, and wherein said stitching comprises first stitching not visible from the exterior of said bag at said first fold, and second stitching spaced from said first fold and visible from the exterior of said bag.

7. An accessory as recited in claim 6 wherein said belt attachment comprises an elongated belt loop formed in said back panel; and further comprising a belt extending through said elongated belt loop and having a plastic male fastener at or adjacent a first end thereof, and a cooperating plastic female fastener at or adjacent a second end thereof.

8. An accessory as recited in claim 1 further comprising a nylon cord attached to at least one of said front and back panels, and to a key ring, so that said key ring extends into said interior volume adjacent said opening.

9. An accessory as recited in claim 8 wherein said nylon cord is sewn to both said front and back panels adjacent said side edges thereof.

10. An accessory as recited in claim 9 wherein said attachment means comprises stitching.

11. An accessory as recited in claim 10 wherein said front and back panels are folded to provide a first fold at said side edges thereof, and wherein said stitching comprises first stitching not visible from the exterior of said bag at said first fold, and second stitching spaced from said first fold and visible from the exterior of said bag.

12. An accessory as recited in claim 11 wherein said belt attachment comprises an elongated belt loop formed in said back panel; and further comprising a belt extending through said elongated belt loop and having a plastic male fastener at or adjacent a first end thereof, and a cooperating plastic female fastener at or adjacent a second end thereof.

13. An accessory as recited in claim 11 further comprising a nylon pouch large enough to hold a cell phone or eyeglasses attached to said back panel opposite said front panel so that said pouch is hidden when said bag is worn on a belt around a human's waist with said front panel facing outwardly from the human.

14. An accessory as recited in claim 13 further comprising a nylon pouch large enough to hold a cell phone or eyeglasses attached to said back panel opposite said front panel so that said pouch is hidden when said bag is worn on a belt around a human's waist with said front panel facing outwardly from the human.

15. An accessory for holding tennis balls in association with a user while the user is playing tennis, comprising:

a bag formed of nylon and comprising: a back panel with a top and a bottom and first and second sides, and a first length from the top to the bottom thereof; a front panel having a top and a bottom and first and second sides and a second length from the top to the bottom thereof, said second length less than the first length so that said top and bottom of said front and rear panels are spaced from each other; and attachment means for holding said front panel to said back panel along or adjacent said first and second side edges of said front panel;

said front and back panels being integral at said bottoms thereof;

an interior volume of said bag defined between said front and rear panels, and an opening being provided at said top of said front panel large enough for passage of a regulation tennis ball therethrough, and said interior volume being large enough to hold at least one regulation tennis ball therein with ready access through said opening;

elastic at said opening associated with said front panel for biasing said front panel to partially close said opening;

a nylon cord attached to at least one of said front and back panels, and to a key ring, so that said key ring extends into said interior volume adjacent said opening; and a belt attachment at said top of said back panel.

16. An accessory as recited in claim 15 wherein said nylon cord is elastic, and is sewn to both said front and back panels adjacent said side edges thereof.

17. An accessory as recited in claim 15 wherein said front and back panels are double folded to define a first fold at said side edges thereof, and wherein said stitching comprises first stitching not visible from the exterior of said bag at said first fold and second stitching spaced from said first fold and visible from the exterior of said bag.

18. An accessory for holding tennis balls in association with a user while the user is playing tennis, comprising:

a bag formed of nylon and comprising: a back panel with a top and a bottom and first and second sides, and a first length from the top to the bottom thereof; a front panel having a top and a bottom and first and second sides and a second length from the top to the bottom thereof, said second length less than the first length so that said top and bottom of said front and rear panels are spaced from each other; and attachment means for holding said front panel to said back panel along or adjacent said first and second side edges of said front panel;

said front and back panels being integral at said bottoms thereof;

an interior volume of said bag defined between said front and rear panels, and an opening being provided at said top of said front panel large enough for passage of a regulation tennis ball therethrough, and said interior volume being large enough to hold at least one regulation tennis ball therein with ready access through said opening;

elastic at said opening associated with said front panel for biasing said front panel to partially close said opening;

wherein said front and back panels are folded to define a first fold at said side edges thereof, and wherein said stitching comprises first stitching not visible from the exterior of said bag at said first fold, and second stitching spaced from said first fold and visible from the exterior of said bag; and a belt attachment at said top of said back panel.

19. An accessory as recited in claim 18 further comprising a nylon pouch large enough to hold a cell phone or eyeglasses attached to said back panel opposite said front panel so that said pouch is hidden when said bag is worn on a belt around a human's waist with said front panel facing outwardly from the human.

20. An accessory as recited in claim 19 wherein said belt attachment comprises an elongated belt loop formed in said back panel; and further comprising a belt extending through said elongated belt loop and having a plastic male fastener at or adjacent a first end thereof, and a cooperating plastic female fastener at or adjacent a second end thereof; and wherein said pouch is attached to said elongated belt loop by stitching.

* * * * *